US009336916B2

(12) United States Patent
Stevenson

(10) Patent No.: US 9,336,916 B2
(45) Date of Patent: May 10, 2016

(54) TC-99M PRODUCED BY PROTON IRRADIATION OF A FLUID TARGET SYSTEM

(75) Inventor: Nigel R. Stevenson, Sugar Hill, GA (US)

(73) Assignee: TcNet, LLC, Bridgewater, NJ (US)

( * ) Notice: Subject to any disclaimer, the term of this patent is extended or adjusted under 35 U.S.C. 154(b) by 831 days.

(21) Appl. No.: 13/106,634

(22) Filed: May 12, 2011

(65) Prior Publication Data

US 2011/0280357 A1 Nov. 17, 2011

Related U.S. Application Data

(60) Provisional application No. 61/334,697, filed on May 14, 2010.

(51) Int. Cl.
*G21G 1/10* (2006.01)
*G21G 1/00* (2006.01)

(52) U.S. Cl.
CPC ..... *G21G 1/001* (2013.01); *G21G 1/10* (2013.01); *G21G 2001/0042* (2013.01)

(58) Field of Classification Search
CPC ... G21K 5/08; G21G 1/10; G21G 2001/0036; G21G 2001/0042; G21G 2001/0015
See application file for complete search history.

(56) References Cited

U.S. PATENT DOCUMENTS 3,382,152 A * 5/1968 Lieberman et al. ..... 376/186
3,736,101 A * 5/1973 Pirtle, Jr. ..... 422/256
3,971,697 A 7/1976 Blue
4,039,835 A * 8/1977 Colombetti ..... 250/432 PD
5,296,203 A 3/1994 Phillips et al.
5,417,391 A 5/1995 Savitsky et al.
5,422,345 A 6/1995 Dougan
5,425,063 A 6/1995 Ferrieri et al.
5,440,211 A 8/1995 Jongen
5,784,423 A * 7/1998 Lidsky et al. ..... 376/156
5,910,971 A * 6/1999 Ponomarev-Stepnoy et al. ..... 376/189
5,917,874 A 6/1999 Schlyer et al.
6,433,336 B1 8/2002 Jongen et al.
6,567,492 B2 * 5/2003 Kiselev et al. ..... 376/195

(Continued)

OTHER PUBLICATIONS

Beaver, J.E. and Hupf, H.B., "Production of 99mTc on a Medical Cyclotron: A Feasibility Study" J. Nuc. Med. vol. 12, No. 11, pp. 739-741.*

(Continued)

*Primary Examiner* — Jack W Keith
*Assistant Examiner* — Sharon M Davis
(74) *Attorney, Agent, or Firm* — Wood, Herron & Evans, LLP

(57) ABSTRACT

Methods for producing Tc-99m radioisotope by proton irradiation of a fluid target matrix. A method of producing Tc-99m includes irradiating a fluid target matrix comprising Mo-100 with a proton beam to transform at least a portion of Mo-100 to Tc-99m. Optionally, the fluid target matrix further includes at least one of O-18, O-16, or N-14, which upon exposure to the proton beam concurrently transform at least a portion of O-18 to F-18, at least a portion of O-16 to N-13, at least a portion of the O-16 to O-15, or at least a portion of N-14 to C-11. The method further includes isolating Tc-99m and optionally at least one of F-18, N-13, O-15, or C-11 from the irradiated fluid target matrix. An additional source of Tc-99m is available from the decay of Mo-99 that is co-produced from the Mo-100 during irradiation with the proton beam.

23 Claims, 1 Drawing Sheet

(56) References Cited

U.S. PATENT DOCUMENTS

| | | | | |
|---|---|---|---|---|
| 6,617,574 | B2 | 9/2003 | Kelson et al. | |
| 6,651,349 | B2 | 11/2003 | Coplon et al. | |
| 6,683,426 | B1 | 1/2004 | Kleeven | |
| 6,717,162 | B1 | 4/2004 | Jongen | |
| 6,770,891 | B2 | 8/2004 | Rose | |
| 6,777,692 | B2 | 8/2004 | Jongen | |
| 6,780,850 | B1 | 8/2004 | Dougan et al. | |
| 6,845,137 | B2 | 1/2005 | Ruth et al. | |
| 6,873,123 | B2 | 3/2005 | Marchand et al. | |
| 7,023,000 | B2 | 4/2006 | Zyuzin | |
| 7,140,881 | B1 | 11/2006 | Gealon | |
| 7,163,419 | B2 | 1/2007 | Stanford | |
| 7,197,111 | B2 | 3/2007 | Rose et al. | |
| 7,289,600 | B2 | 10/2007 | Herer et al. | |
| 7,307,264 | B2 | 12/2007 | Brusasco et al. | |
| 7,345,291 | B2 | 3/2008 | Kats | |
| 7,446,490 | B2 | 11/2008 | Jongen et al. | |
| 7,456,591 | B2 | 11/2008 | Jongen | |
| 7,486,771 | B2 | 2/2009 | Stichelbaut et al. | |
| 7,512,206 | B2 | 3/2009 | Wieland | |
| 7,513,193 | B2 | 4/2009 | Allen et al. | |
| 7,860,216 | B2 | 12/2010 | Jongen et al. | |
| 7,940,881 | B2 * | 5/2011 | Jongen et al. | 376/157 |
| 2003/0006379 | A1 | 1/2003 | Hino et al. | |
| 2005/0069076 | A1 | 3/2005 | Bricault et al. | |
| 2006/0022127 | A1 | 2/2006 | Zyuzin | |
| 2007/0217561 | A1 | 9/2007 | Wieland et al. | |
| 2007/0297554 | A1 * | 12/2007 | Lavie et al. | 376/190 |
| 2008/0023645 | A1 | 1/2008 | Amelia et al. | |
| 2008/0241025 | A1 | 10/2008 | Lapi et al. | |
| 2009/0090875 | A1 | 4/2009 | Gelbart et al. | |
| 2010/0059688 | A1 | 3/2010 | Claereboudt et al. | |
| 2010/0166653 | A1 | 7/2010 | Stevenson et al. | |
| 2010/0243875 | A1 | 9/2010 | Plompen et al. | |
| 2010/0272241 | A1 | 10/2010 | Amelia et al. | |
| 2011/0002431 | A1 | 1/2011 | Johnson et al. | |
| 2012/0307953 | A1 | 12/2012 | Stevenson | |

OTHER PUBLICATIONS

Technetium-99m, from Wikipedia, printed Mar. 21, 2011 (7 pages).
Targholizadeh et al, Cyclotron production of technetium radionuclides using a natural metallic molybdenum thick target and consequent preparation of [Tc]-BRIDA as a radio-labelled kit sample, Nukleonika 2010, 55(1):113-118.
Montgomery, An Accelerator-Based Temporary Solution to the Medical Isotope Shortage, Canadian Undergraduate Physics Journal, vol. VII, Issue 2, May 2010, pp. 10-11.
Takacs, et al, Evaluation of proton induced reactions on 100Mo: New cross sections for production of 99mTc and 99Mo, Journal of Radioanalytical and Nuclear Chemistry, vol. 257, No. 1, 195-201, printed Mar. 21, 2011 from www. springerlink.com/content/q416677r44765223/abstract, Abstract and preview page only (3 pages).
Pugachev et al, Design of the Target for 99Mo Production in the Electron Linear Accelerator, (2 pages).
Chemistry & Medical Isotopes, Medical Isotopes for Canada: A Role for Chemistry and TRIUMF, Canada's National Laboratory for Particle and Nuclear Physics, printed from ww.triumf.ca/chemistry/chemistry-medical-isotopes Mar. 21, 2011 (3 pages).
Dehnel, et al, a Compact Cost-Effective Beamline for a PET Cyclotron (9 pages).
Carney, Principles of PET Imaging, Multi-modal Neuroimaging Training Program (MNTP), Tuesday, Jun. 19, 2007 (21 pages).
Radionuclides & Radiopharmaceuticals, Centre for Positron Emission Tomography, Austin Hospital, Melbourne, Australia, printed from www.petnm.unimelb.edu.au/pet/detail/radionuc, Apr. 14, 2011 (4 pages).
Scholten et al, Excitation functions for the cyclotron production of 99mTc and 99Mo, Applied Radiation and Isotopes 51 (1999) 69-80.
Tang, Radionuclide production and yields at Washington University School of Medicine, QJ Nucl Med Mol Imaging 2008, 52:121-33.
Lewis, 99Mo supply—the times they are a-changing, Eur J Nucl Med Mol Imaging (2009) 36:1371-1374.
Hong et al, The Performance of Double-Grid 0-18 Water Target for FDG Production, Proceedings of EPAC 2006, Edinburgh, Scotland, WEPCH173, pp. 2337-2339.
European Patent Office International Search Report for PCT/US2011/036447 filed on May 13, 2011, report mailed on Oct. 4, 2011; 11 pp.
Lagunas-Solar M C, Acceleratori Production of 99mTc With Proton Beams and Enriched 100Mo, Targets, IAEA Technical Documents Series, Internation Atomic Energy Agency, AT, No. IAEA-TECDOC-1065, Jan. 1, 1999, pp. 87-112.
Egan G. et al., An Investigation Into the Technical Feasibility of Cyclotron Production of Technetium-99m, ANZ Nuclear Medicine, LLE, Mar. 1, 1994, pp. 25-31.
International Bureau, International Preliminary Report on Patentability issued in corresponding International Application No. PCT/US2012/040403 on Dec. 2, 2013, 6 pages.
European Patent Office International Search Report for PCT/US2012/040403 filed on Jun. 1, 2012, report mailed on Sep. 17, 2012; 9 pp.
Cuninghame, J.G., et al., Large Scale Production of 123I from a Flowing Liquid Target Using the (p, 5n) Reaction, Int J. Appl. Radiat. Isot., vol. 27, 1976, pp. 597-603. (7pp).
Nutter, J.L. et al., Production of 77Br for TDPAC Studies, Appl. Radiat. Isot., vol. 43, 1992, pp. 1393-1398. (6pp.).
Galiano, E, et al., The Cyclotron Production of Carrier-free 77Br via the 79Br(p, 3n)77Kr 77Br Reaction using a Liquid Target and On-line Extraction, Appl. Radiat. Isot., vol. 49, 1996, pp. 105-111. (7pp.).
Ralis, J., et al., Liquid Target System for Production of 86Y, The 13th International Workshop on Targetry and Target Chemistry Proceedings, Riso-R-1787(EN), Jun. 2011, pp. 234-235. (3 pp.).
Jensen, M., et al., Direct Production of Ga-68 from Proton Bombardment of Concentrated Aqueous Solutions of [Zn-68] Zinc Chloride, The 13th International Workshop on Targetry and Target Chemistry Proceedings, Riso-R-1787 (EN), Jun. 2011, pp. 288-289. (3 pp.).

* cited by examiner

TC-99M PRODUCED BY PROTON IRRADIATION OF A FLUID TARGET SYSTEM

CROSS-REFERENCE TO RELATED APPLICATIONS

This application claims the benefit of U.S. Provisional Application No. 61/334,697, filed May 14, 2010, which is hereby incorporated by reference herein in its entirety.

FIELD OF THE INVENTION

The invention relates to production of Tc-99m radioisotope by proton irradiation of a fluid target matrix.

BACKGROUND OF THE INVENTION

Technetium-99m (Tc-99m) is the most commonly used radioisotope in nuclear medicine. Typically, Tc-99m is obtained from Mo-99/Tc-99m generator systems, which are self-contained systems housing a parent (Mo-99)-daughter (Tc-99m) mixture in equilibrium. Commercially, molybdenum-99 is produced in a high-flux nuclear reactor from the irradiation of highly-enriched uranium targets (93% Uranium-235) and shipped to generator manufacturing sites. Mo-99/Tc-99m generators are then distributed from these centralized locations to hospitals and pharmacies through-out the country. Because the number of production sites are limited, and compounded by the limited number of available high flux nuclear reactors, the supply of Mo-99 is susceptible to frequent interruptions and shortages resulting in delayed nuclear medicine procedures.

To try and address this problem, alternative methods of producing Mo-99 and/or Tc-99 are being undertaken. Because Mo-99 has a 2.7 day half-life, which allows for country-wide distribution, most efforts have focused on producing Mo-99. For example, three standard approaches toward the formation of Mo-99 include:

$$^{235}U_{92}+{}^{1}n_0\rightarrow{}^{99}Mo_{42}+x\,{}^{1}n_0+\text{many other nuclei} \quad (1)$$

$$^{98}Mo_{42}+{}^{1}n_0\rightarrow{}^{99}Mo_{42}+\gamma \quad (2)$$

$$^{100}Mo_{42}+\gamma\rightarrow{}^{99}Mo_{42}+{}^{1}n_0 \quad (3)$$

Other approaches have considered directly producing Tc-99m, which has a 6 hour half-life, for local use. The Mo-100(p,2n)Tc-99m reaction (see Equation 4) is one method under investigation where a conventional electroplated, compacted powder or melted solid target is irradiated with a proton beam, such as that provided by a cyclotron, and subsequently processed to isolate Tc-99m from the target matrix.

$$^{100}Mo_{42}+{}^{1}H_1\rightarrow{}^{99m}Tc_{43}+2\,{}^{1}n_0 \quad (4)$$

Positron emission tomography (PET) cyclotrons are in widespread use at hospitals, pharmacies, mobile PET and other facilities, and therefore are an attractive source of energetic protons. However, the solid target approach is cumbersome and not well-suited for in-house hospital locations where automated chemistry is highly desired. For example, isolating technetium from solid molybdenum requires oxidative dissolution of the metallic target and separation of the chemical species. Thus, while large yields are potentially possible with this method, delays in processing and intensive handling/processing could cause substantial decay losses and increased processing costs.

In addition to the wide-spread availability of PET cyclotrons, these systems are generally fitted with commercially-available F-18 production targets and automated chemistry systems to manufacture fluorinated deoxyglucose (FDG). The F-18 production target is a cylindrical, conical or similar hollow container filled with $H_2{}^{18}O$ which is irradiated with a proton beam and forms F-18 by the nuclear reaction $^{18}O(p,n)^{18}F$. The irradiated water is transferred to the automated chemistry system, which extracts the $^{18}F$ and produces the desired end product, $^{18}FDG$, in a Good Manufacturing Practices (GMP) environment ready for clinical use. However, a viable method that can take advantage of the foregoing attributes of PET cyclotron FDG systems to prepare Tc-99m does not currently exist.

Accordingly, new methods of generating Tc-99m with a PET cyclotron (or a similar accelerator) and associated targetry and chemistry systems are needed.

SUMMARY OF THE INVENTION

According to one embodiment of the invention, a method of producing Tc-99m is provided. The method comprises irradiating a fluid target matrix comprising Mo-100 with a proton beam to transform at least a portion of the Mo-100 to Tc-99m and provide an irradiated fluid target matrix, and then isolating the Tc-99m from the irradiated fluid target matrix.

According to another embodiment of the invention, a method of producing a plurality of radionuclides is provided. The method comprises irradiating a fluid target matrix comprising Mo-100 and at least one of O-18, O-16, or N-14 with a proton beam to transform at least a portion of the Mo-100 to Tc-99m, and transform at least a portion of the O-18 to F-18, at least a portion of the O-16 to N-13, or at least a portion of the N-14 to C11, at least a portion of the O-16 to O-15, and thereby provide an irradiated fluid target matrix; and separating from the irradiated fluid target matrix at least a portion of the Tc-99m and at least a portion of the F-18, the N-13, O-15, and/or the C-11.

BRIEF DESCRIPTION OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention.

DETAILED DESCRIPTION OF EMBODIMENTS OF THE INVENTION

The method and processes described herein provide for the generation and isolation of Tc-99m, and optionally other radionuclides such as F-18, N-13, and/or C-11, at commercially-viable yields and without utilizing a high flux nuclear reactor. Briefly, the process includes preparing one or more targets comprising a fluid target matrix containing enriched molybdenum (Mo-100), and optionally suitable F-18, N-13, and/or C-11 precursors. The fluid target matrix is irradiated with a proton beam to transform at least a portion of the Mo-100 to Tc-99m, and optionally transform the F-18, the N-13, and/or the C-11 precursors to their respective object radionuclides. The irradiated fluid target matrix is subjected to a purification process to separate and isolate at least a portion of the desired radionuclides from the matrix of the irradiated fluid target matrix.

As used herein, the term "target material" means a Mo-100-containing substance, which can be carried in a fluid target matrix and when irradiated by a suitable particle beam, such as a proton beam, the Mo-100 in the substance is transformed to produce the radionuclide Tc-99m according to the nuclear equation represented in Equation 4 above.

As used herein, the term "fluid" generally means any suitable flowable medium, such as liquid, gas, vapor, plasma, supercritical fluid, or combinations thereof, that is capable of flowing and easily changing shape.

As used herein, the term "liquid" generally means any fluid that has no independent shape but has a definite volume and does not expand indefinitely and that is only slightly compressible. A liquid is neither a solid nor a gas, but a liquid may have one or more solids and/or gases dissolved therein. Exemplary liquids include water and organic solvents.

As used herein, the terms "vapor" and "gas" may be used interchangeably and generally mean any fluid that can move and expand without restriction except for a physical boundary such as a surface or wall, and thus can include a gas phase, a gas phase in combination with a liquid phase such as a droplet (e.g., steam), supercritical fluid, or the like.

As used herein, the term "fluid target matrix" means any non-solid, flowable medium wherein the target material is contained, solvated, dispersed or the like.

Figure 1:
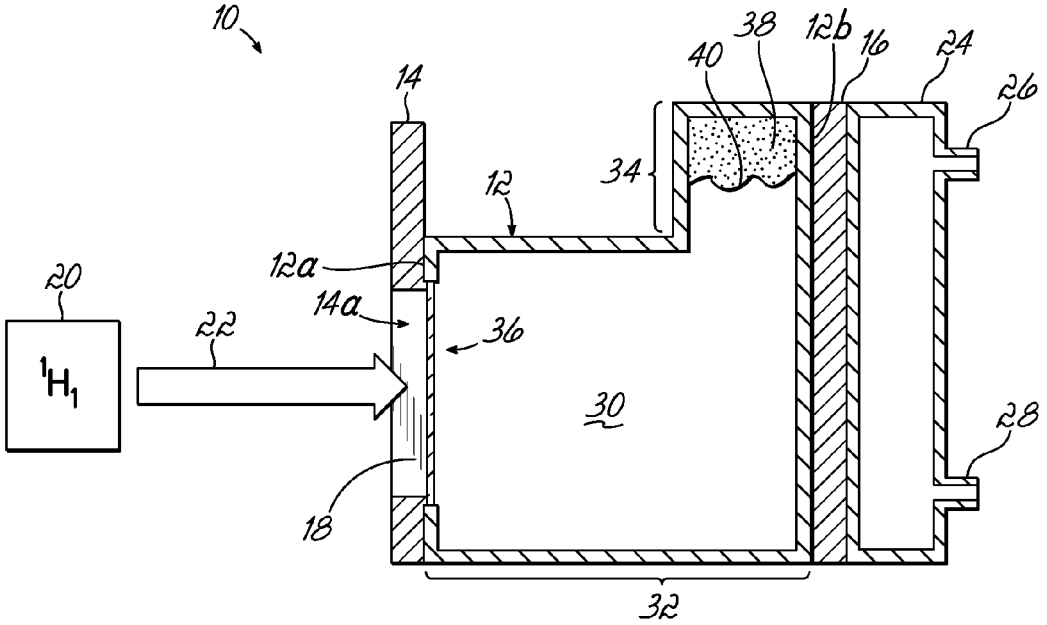
FIG. 1 is a cross-sectional side elevation view of a simplified target assembly in accordance with an embodiment of the invention.

Referring now to FIG. 1, a target assembly 10 includes a target body 12 having a beam side 12*a* and a back side 12*b*. Situated on the beam side 12*a* is a window flange 14 secured to the beam side 12*a* of target body 12, and situated on the back side 12*b* is a back flange 16 secured to the back side 12*b* of target body 12. As appreciated by persons skilled in the art, the various flange sections of target assembly 10 can be secured to each other by any suitable means, such as by using appropriate fastening members such as threaded bolts.

The window flange 14 includes a beam window aperture 14*a* to accommodate a beam window 18 that separates a proton source 20 from the target body 12 but permits the transmission of a proton beam 22 therethrough. Optionally, a beam window cooling system, which is usually in the form of a double window containing a coolant stream, (not shown), may be incorporated into the window flange 14 to provide convectional and/or conductional cooling to the beam window 18. Similarly, the back flange 16 may also include a cooling system 24 having an inlet 26 and outlet 28 for the flowing of a coolant medium therethrough and thereby provide direct cooling to the back flange 16 and/or indirect cooling to the target body 12 and a fluid target matrix 30 contained therein. The inlet 26 and outlet 28 may be configured to be detachably connected to a corresponding coolant supply source (not shown) such that after the irradiation with the proton beam 22, the target assembly 10 may be manually or automatically detached from a target holder and delivered to a processing location (not shown). However, generally the target assembly 10 further includes lines/ports (not shown) to transport fluids to and/or from the target body 12.

According to embodiments of the invention, the fluid target matrix 30 includes Mo-100, which may be derived from various sources. In one example, Mo-100 is derived from one or more molybdenum compounds that are soluble in the fluid target matrix 30. According to one exemplary embodiment, the fluid target matrix 30 includes a liquid such as water, an aqueous solution, or an organic solvent. Accordingly, a source of Mo-100 may include one or more molybdenum compounds that are soluble in water, aqueous solutions, and/or organic solvents. Advantageously, the liquid target matrix embodiments are generally adaptable to existing PET F-18/FDG systems with little or no significant modifications to the target assembly 10.

According to one example, a liquid component of the liquid target matrix includes water, which may be natural water ($H_2{}^{16}O$) or isotopically-enriched O-18 water, i.e., $H_2{}^{18}O$. Accordingly, the Mo-100 source includes water-soluble molybdenum compounds and related forms of molybdenum complexes that can be formed in aqueous solutions. For example, metallic molybdenum can be converted to molybdate ($MoO_4{}^{-2}$) by oxidizing the metal in basic media or molybdenum oxide ($MoO_3$) can be converted to molybdate by dissolving in an appropriate aqueous solution.

In strongly basic solutions, molybdate is found as a mononuclear $MoO_4{}^{-2}$ ion. As the pH approaches neutrality, however, condensation of the molybdate ions into polynuclear clusters occurs. For example, ammonium molybdate is most commonly found as the heptamolybdate $(NH_4)_6Mo_7O_{24}$, which can crystallize from aqueous solutions as a tetrahydrate ($(NH_4)_6Mo_7O_{24}.4H_2O$). Ammonium heptamolybdate is a particularly useful form of molybdenum due to its high Mo content (57.7% weight percent) compared to diammonium molybdate (48.9%), disodium molybdate (46.6%), or dipotassium molybdate (40.3%). Coupled with the appreciable room-temperature solubility of ammonium heptamolybdate, ca. 40.5 g/100 mL, provides aqueous solutions having about 23.4 grams of molybdenum per 100 mL of solution.

The pH of the aqueous target matrix can be varied to enhance the compatibility of the aqueous target matrix and the materials used in constructing the target assembly 10 that contact the aqueous target matrix. According to embodiments of the invention, the pH may range from about 2 to about 12, from about 4 to 10, from about 5 to 9, or from about 6 to about 8. In one example, the pH ranges from about 6.5 to about 7.

According to another example, a liquid component of the liquid target matrix includes an organic solvent. Accordingly, the Mo-100 source can include organic solvent-soluble molybdenum compounds and related forms of molybdenum complexes that can be formed in organic solvents. For example, molybdenum chloride ($Mo_2Cl_{10}$) is soluble in organic solvents such as diethyl ether and a various chlorinated organic solvents.

According to another embodiment, the fluid target matrix is a gaseous target matrix that comprises a gas and optionally one or more carrier or target gases. Accordingly, the Mo-100 is derived from a gaseous molybdenum compound. As such, a source of Mo-100 may include one or more molybdenum compounds that are capable of being volatilized under appropriate conditions and then flowed into and/or through the target body 12. Optionally, one or more carrier cases may be used to facilitate the transfer of the gaseous Mo-100 compound. An exemplary molybdenum compound capable of volatilization include molybdenum hexacarbonyl ($Mo(CO)_6$), which has a boiling point of 156° C. at atmospheric pressure and readily sublimes. Advantageously, the gaseous target matrix embodiments are generally adaptable to existing PET targets used for generating C-11 from N-14 without substantial modifications to the C-11 PET target assembly 10.

Other atomic and isotopic species may also be included in the liquid target matrix or the gaseous target matrix to enable the concurrent formation of other radionuclides, such as F-18, N-13, and/or C-11. For example, fluorine-18 can be produced by proton bombardment of oxygen-18 through the $^{18}O(p,n)^{18}F$ nuclear reaction. Accordingly, to enable the concurrent production of F-18 and Tc-99m, isotopically enriched oxygen (O-18) may be included in the fluid target matrix 30 in the form of $H_2{}^{18}O$, $^{18}O_2$, and/or $^{100}Mo^{18}O_3$, for example.

Additionally, nitrogen-13 can be produced by proton bombardment of natural oxygen, which is greater than 99.7% oxygen-16, through the $^{16}O(p,\alpha)^{13}N$ nuclear reaction. Accordingly, to enable the concurrent production of N-13 and Tc-99m, distilled water ($H_2{}^{16}O$), $^{16}O_2$, and/or $^{100}Mo^{16}O_3$, may be included in the fluid target matrix 30 to produce $^{13}NH_3$. The use of a scavenger for oxidizing radicals has been successfully used to minimize in-target oxidation. One exemplary scavenger is ethanol.

Furthermore, carbon-11 can be produced by proton bombardment of natural nitrogen, which is greater than 99.6% nitrogen-14, through the $^{14}N(p,\alpha)^{11}C$ nuclear reaction. Accordingly, to enable the concurrent production of C-11 and Tc-99m, a nitrogen source, such as $^{14}NH_3$, $^{14}NH_4{}^{+1}$, $^{14}N_2$, $^{14}N^{16}O_3{}^{-1}$, or $^{14}N^{18}O_3{}^{-1}$, may be included in the fluid target matrix 30. For example, ammonium heptamolybdate $(^{14}NH_4)_6{}^{100}Mo_7O_{24}$ conveniently provides both Mo-100 and N-14 in the target material. Alternatively, a target gas mixture of 2% oxygen in nitrogen or 5% hydrogen in nitrogen may be combined with a volatile Mo-100 compound in the fluid target matrix 30 to produce carbon dioxide ($^{11}CO_2$) or methane ($^{11}CH_4$), respectively, along with Tc-99m. Carbon monoxide ($^{11}CO$) can also be made by reduction of $^{11}CO_2$ on activated charcoal at 900° C.

The target body 12 can be constructed from any material that is compatible with the fluid target matrix 30. Exemplary and non-limiting examples of suitable materials use in constructing the target body 12 include stainless steel (e.g., SS 316), tantalum, HAVAR™, and polyether ether ketone (PEEK). Compatibility of the materials used in the target body 12 can be evaluated by heating the proposed material to anticipated irradiation temperatures in the presence of the fluid target matrix 30.

The target body 12 of the target assembly 10 is not restricted to any particular shape or configuration. As shown in FIG. 1, the target body 12 may have a generally L-shaped cross-section that defines or has formed in its structure a target chamber 32 that is in fluid communication with an upper chamber 34. The upper chamber 34 is usually adapted to include ports (not shown), which accommodate introducing the fluid target matrix 30 into the target body 12 and/or removing the irradiated fluid target matrix after the irradiation of the fluid target matrix 30 with the proton beam 22. The target chamber 32 is represented by the lower leg of this L-shaped target body 12 and terminates at a beam strike section 36 of the beam side 12*a* for receiving the proton beam 22.

Additional optional features of the target body 12 may include a pressure transducer and/or a thermocouple, which are in fluid communication with the target chamber 32 and/or the upper chamber 34, and which also are in electrical communication with external instrumentation to provide pressure and temperature information relating to the inside of the target body 12.

In the liquid target matrix embodiment shown in FIG. 1, a portion of the upper chamber 34 may include a gaseous region 38, which thereby provides a liquid—gas interface 40 within the upper chamber 34. The liquid—gas interface 40 can facilitate modulating pressure changes arising from thermal expansion and contraction of the liquid target matrix during and after the irradiation step.

As further shown in FIG. 1, the beam window 18 is interposed between target body 12 and window flange 14 and defines beam strike section 36 of target chamber 32. Beam window 18 can be constructed from any material suitable for transmitting the proton beam 22 while minimizing loss of beam energy. A non-limiting example is a metal alloy such as the commercially available HAVAR™ alloy, although other metals such as titanium, tantalum, tungsten, stainless steel (e.g., SS 316), gold, and alloys thereof could be employed. Another purpose of beam window 18 is to demarcate and maintain the pressurized environment within target chamber 32 and the vacuum environment through which particle beam 22 is introduced to target chamber 32 at beam strike section 36. The thickness of beam window 18 can be sufficiently small so as not to degrade beam energy, and thus can range, for example, between approximately 0.3 and 50 μm. In one exemplary embodiment, the thickness of beam window 18 is approximately 25 μm. Compatibility of the materials used in the beam window 18 can be evaluated by heating the proposed material to anticipated irradiation temperatures in the presence of the fluid target matrix 30.

The window flange 14 in one non-limiting example is constructed from aluminum. Other suitable non-limiting examples of materials for window flange 14 include gold, copper, titanium, and tantalum. Window flange 14 defines the beam window aperture 14*a* generally aligned with beam window 18 and beam strike section 36 of target chamber 32.

Optionally, a window grid, which is not shown, can be mounted within beam window aperture 14*a* and abut beam window 18. The window grid may be useful in embodiments where the beam window 18 has a small thickness and therefore is subject to possible buckling or rupture in response to fluid pressure developed within target chamber 32. The window grid can have any design suitable for adding structural strength to the beam window 18, and thus prevent structural failure of beam window 18, while not appreciably interfering with the transmission of the proton beam 22. Accordingly, a window grid can comprise a plurality of hexagonal or honeycomb-shaped tubes having a depth of along the axial direction of beam travel ranging from about 1 to about 4 mm, and the width between the walls of each hexagonal or honeycomb-shaped tube can range from about 1 to about 4 mm. Where additional strength is not needed for the beam window 18, the window grid can be omitted.

Optionally, a double window (not shown) containing a coolant such as helium gas is may be used, which not only reduces the likelihood of rupturing the beam window 18 but also may remove heat from the beam window 18, the target body 12 and the fluid target matrix 30.

Back flange 16 may also be constructed from aluminum or other suitable materials such as copper and stainless steel. Similar materials may also be used to construct the cooling system 24.

As further shown in FIG. 1, target assembly 10 includes cooling system 24 having an inlet 26 and an outlet 28 for the flowing of a coolant medium therethrough and thereby provide direct cooling to the back flange 16 and/or indirect cooling to the target body 12 and the fluid target matrix 30 contained therein. A primary purpose of the cooling system 24 is to enable the heat energy transferred into target chamber 30 via proton beam 22 to be carried away from target assembly 10 via the circulating coolant. In the illustrated embodiment, the cooling system 24 comprises inlet 26 and outlet 28 to provide a passageway for the circulating coolant. In addition, the cooling system 24 fluidly may communicate with external components including, for example, a motor-powered pump, heat exchanger, condenser, evaporator, and the like.

It should be appreciated by those skilled in the art that the specific form, shape, or dimensions of the various components of the target assembly 10 may be modified and/or adapted to work in combination with each type and model of target holder presently in existence or those to be developed in the future.

The proton source 20 for the proton beam 22 may be of any suitable design. The particular type of proton source 22 employed in conjunction with the embodiments disclosed herein will depend on a number of factors, such as the beam power contemplated and the type of radionuclide to be produced. For example, to produce Tc-99m according to the nuclear reaction of Equation 4, proton energies ranging from about 7 MeV to about 30 MeV is particularly advantageous. Accordingly, average beam energies ranging from about 11 MeV to about 30 MeV, about 13 MeV to about 30 MeV, about 16 MeV to about 30 MeV, about 18 MeV to about 30 MeV, or about 24 MeV to about 30 MeV may be used. For example, average beam energies of 11 MeV, 13 MeV, 16 MeV, 18 MeV, 24 MeV, and 30 MeV are suitable for producing Tc-99m.

Generally, for a beam power ranging up to approximately 1.5 kW (for example, a 100 μA current of protons driven at an energy of 15 MeV), a cyclotron or linear accelerator (LINAC) is typically used for the proton beam source. For a beam power typically ranging from approximately 1.5 kW to 15.0 kW (for example, 0.1-1.0 mA of 15 MeV protons), a cyclotron or LINAC adapted for higher power is typically used for the proton beam source. According to one embodiment and depending on the proton current and energy, between 7 GBq (0.2 Ci) and 83 GBq (2.2 Ci) of Tc-99m per hour of bombardment may be produced from a substantially isotopically-pure Mo-100 target material in a fluid target matrix.

Similar to common F-18/FDG systems, the process of generating Tc-99m may be automated to control the time of bombardment, the energy of the protons and the current of the protons. These and other operating parameters may be determined based on a composition of the fluid target matrix, which is data that may be entered into a general controller.

Figure 2:
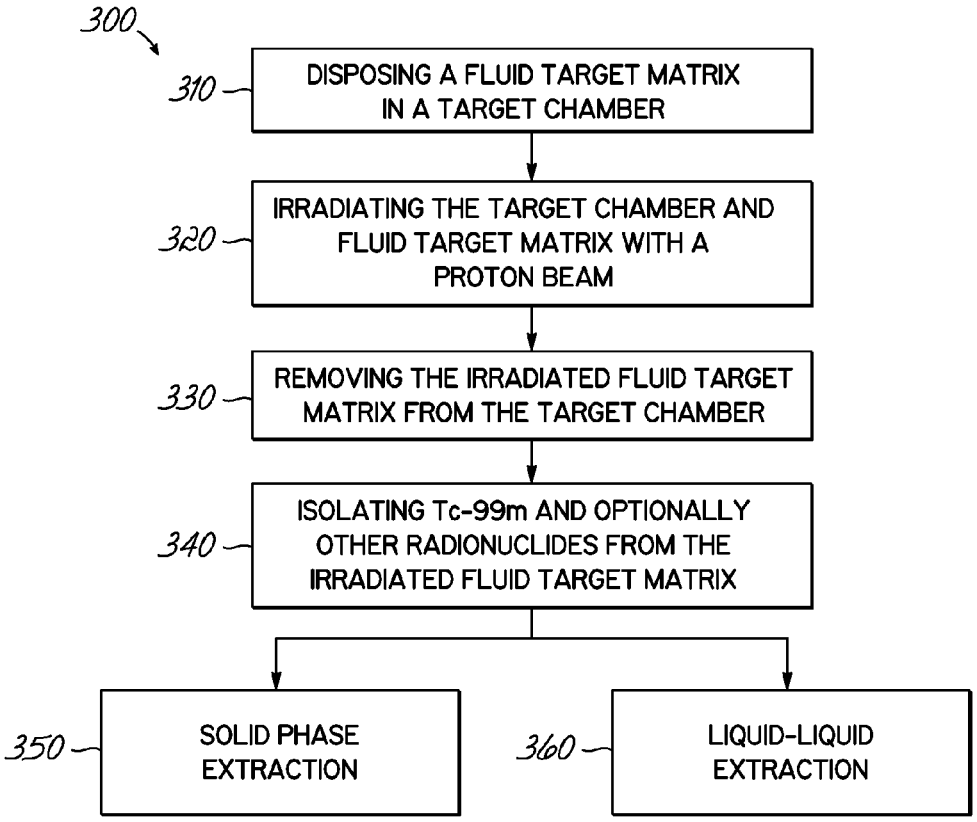
FIG. 2 illustrates a method of producing Tc-99m according to an embodiment of the invention.

Referring now to FIG. 2, a flow chart 300 illustrating an exemplary embodiment of a method for producing Tc-99m is discussed next. The method for producing Tc-99m includes a step 310 of disposing a fluid target matrix in a target chamber. The fluid target matrix includes Mo-100 and optionally O-18, O-16, or N-14. The next step 320 involves irradiating the target chamber and fluid target matrix with a proton beam to transform at least a portion of Mo-100 to Tc-99m, and optionally transform at least a portion of O-18 to F-18, at least a portion of the O-16 to N-13, or at least a portion of N-14 to C11. The irradiation of the fluid target matrix with the beam of protons may last for a time interval sufficient to produce a desired amount of the object radionuclide. For example, the irradiation duration may range between half an hour and 8 hours.

In step 330, at least a portion of the irradiated fluid target matrix is removed from the target body 12 to facilitate isolating Tc-99m and optionally other radionuclides (e.g., F-18, N-13 or C-11). In step 340, Tc-99m and optionally other radionuclides are isolated from the irradiated fluid target matrix. Several complementary procedures may be used alone or in combination to achieve the desired purification. For example and as discussed further below, the irradiated fluid target matrix may be removed from the target body 12 and transferred to a chemical processing station, which may include an automated chemistry unit. Chemical processing, such as solid phase extraction 350, liquid-liquid extraction 360, or combinations thereof may be used to recover Mo-100 and purify Tc-99m and the other radioisotopes. Exemplary substrates suitable for solid phase extraction include, but are not limited to, alumina, silica, ion exchange resins, or combinations thereof. Liquid-liquid extractions may be performed using two immiscible solvents, such as an organic solvent (e.g., methyl ethyl ketone), and aqueous solutions, which may be intermixed in any suitable manner to partition the irradiated target matrix between the phases. While the Tc-99m is to be consumed in various medical imaging procedures, the recovered Mo-100 may be recycled and further processed to provide additional batches of Tc-99m.

In accordance with one embodiment, the method of producing a plurality of radionuclides includes irradiating a fluid target matrix containing Mo-100 and O-18, with a proton beam to transform at least a portion of the Mo-100 to Tc-99m, and transform at least a portion of the O-18 to F-18. For example, the fluid target matrix may include a solution of molybdate (e.g., ammonium molybdate) dissolved in $H_2{}^{18}O$. After irradiating the fluid target matrix with the proton beam having a sufficient energy for a sufficient duration, at least a portion of the Tc-99m and at least a portion of the F-18 are separated from each other, as well as separated from at least a portion of the Mo-100 target material.

For example, one method of separating Mo-100, Tc-99m, and F-18 may include passing the irradiated target matrix through a solid phase column to retain at least a portion of the F-18 therein and pass Mo-100 and Tc-99m, which may be further processed. A quaternary ammonium column (e.g., AccellPlus QMA Sep-Pak® Light) is a commonly used solid phase column in FDG synthesis. At or near neutral to low pH, F-18 would be retained, while the molybdenum and technetium would likely pass, thereby permitting facile application of the retained F-18 to FDG synthesis. The passed solution containing molybdenum and technetium may be subjected to further chemical processing as discussed below.

Another method of separating Mo-100, Tc-99m, and F-18 may include passing the irradiated target matrix through a different solid phase column, to retain at least a portion of the F-18 and at least a portion of the Mo-100 while passing Tc-99m. Fluoride may be adsorbed by alumina columns at neutral to high pH values, being released at lower pHs. Similarly, molybdenum, in the form of molybdate, may be adsorbed under the conditions found in the irradiated target matrix and released at higher pHs. The passed solution of technetium may be subjected to chemistries discussed further below. Skilled artisans will appreciate that the generation of the Tc-99m at local and regional medical cyclotron centers would reduce the dependence on the supply chain originating at nuclear reactor or intense electron current accelerator facilities. Tc-99m may be created and presented to a nuclear medicine radiopharmacist in a manner that blends into their established protocols, following existing procedures for the F-18 FDG distribution. Thus, no major change is necessary for the recipients of the Tc-99m.

It should be further noted that Mo-99 is also produced by the Mo-100(p,pn) reaction when irradiating Mo-100 with a proton beam, and thus may be available in the recovered Mo-100 as source of Tc-99m by the natural decay of Mo-99. As such, if desired, the isolated molybdenum fraction containing Mo-99 may be subjected to further periodic processing similar to that used with the conventional Mo-99/Tc-99m generator to obtain the Tc-99m.

The embodiments of the invention are illustrated by the following examples that are not to be regarded as limiting the scope of the invention or the manner in which it can be practiced. It should be noted that various chemistries were first developed using non-irradiated natural molybdenum and then applied to natural molybdenum target materials after having been subjected to proton irradiation.

Preparation of Model Molybdenum Target Material:

Solid Ammonium Heptamolybdate ($(NH_4)_6Mo_7O_{24}$) may be prepared according to the following exemplary procedure. Molybdenum oxide ($MoO_3$, natural abundance, 14.40 g, 0.100 mole) was dissolved in 1 N $NH_3$ (150 mL, 0.150 mole) with heating (ca. 50° C.). The solution was evaporated down to ca. 40 mL under a nitrogen stream. The precipitated, white crystals of ammonium heptamolybdate tetrahydrate ($(NH_4)_6Mo_7O_{24}.4H_2O$) were removed by filtration, washed with ethanol, and air dried. The yield of this first crop was 7.40 g (0.00599 mole (as the tetrahydrate), 41.9%.) Upon heating, the air dried product appeared to lose water at ca. 90-100° C., indicated by the crystals becoming opaque. However, melting was not observed below 300° C., which diverted from the literature reported melting point of 190° C. Ammonium heptamolybdate tetrahydrate obtained from Acros Organics (NJ, USA), displayed the same thermal behavior as the material produced in this laboratory. The solubility of the prepared ammonium heptamolybdate tetrahydrate in water at room temperature was about 43 g/100 mL and providing a solution having a density of about 1.27 g/mL.

Solid Potassium Molybdate ($K_2MoO_4$) may be prepared by dissolving $MoO_3$ in a basic aqueous solution of potassium hydroxide (KOH) and crystallizing the filtered product to yield potassium molybdate pentahydrate ($K_2MoO_4.5H_2O$). The anhydrous salt may be prepared by heating to a sufficient temperature to liberate the water.

Solid Sodium Molybdate ($Na_2MoO_4$) may be prepared by dissolving $MoO_3$ in a basic aqueous solution of sodium hydroxide (NaOH) and crystallizing the filtered product to yield sodium molybdate dihydrate ($Na_2MoO_4.2H_2O$). The anhydrous salt may be prepared by heating to a sufficient temperature to liberate the water.

Solutions of exemplary molybdenum salts (e.g., ammonium molybdate, potassium molybdate, or sodium molybdate) may be prepared by dissolving molybdenum oxide in a basic aqueous solution including water and an appropriate base (e.g., ammonium hydroxide, potassium hydroxide, or sodium hydroxide, respectively).

Compatibility of Materials Used in Target Assembly:

Polyether ether ketone (PEEK) was evaluated for compatibility with a saturated ammonium heptamolybdate (AM) solution by placing a piece of PEEK tubing and a PEEK fitting in a beaker and covered with saturated AM. A small stirring bar was added to cause flow by and around the PEEK items. The beaker was covered, and the solution heated at 65° C. overnight (17 hours). No discoloration or embrittlement of the PEEK tubing or PEEK fitting was observed.

Aluminum (Al 6061) was evaluated for compatibility with a saturated ammonium heptamolybdate (AM) solution by placing a coupon of Al 6061 on its edge in a beaker and partially covering with saturated AM. A stirring bar was added; the beaker was covered and heated with stirring to 95° C. Within one hour, the solution had become an intense blue-green, indicative of Mo(V) formation, so the heating was stopped. Analysis for Al in solution by Inductively Coupled Plasma-Atomic Emission Spectroscopy (ICP-AES) was equivocal, due to interfering Mo lines. A similar test, using saturated sodium molybdate, resulted in significant gas evolution ($H_2$) upon heating. ICP-AES was also equivocal, but seemed to indicate about 150 ppm Al in solution.

Stainless steel (SS 316) was evaluated for compatibility with a saturated ammonium heptamolybdate (AM) solution by placing a coupon of SS 316 in a beaker and partially covering with saturated AM. The beaker and contents were heated at 85-100° C. After four hours of heating, there appeared to be slight discoloration of the solution; but, due to interfering Mo lines, it was not possible to determine Fe content in solution by ICP-AES. A similar test in saturated sodium molybdate (reflux, six hours) yielded about 2 ppm Fe in solution.

Tantalum (Ta) was evaluated for compatibility with a saturated ammonium heptamolybdate (AM) solution by placing a short cylinder of Ta in a beaker and partially covering with saturated AM. The mixture was stirred and heated at reflux. No color was observed in the solution for five hours. No Ta was observed in solution by ICP-AES.

Niobium (Nb) was evaluated for compatibility with a saturated ammonium heptamolybdate (AM) solution by placing a short cylinder of Nb in a beaker and partially covering with saturated AM. The mixture was stirred and heated at reflux. Within 45 minutes, the solution was dark blue; and the heating was stopped. However, Nb was not detected by ICP-AES analysis of the solution. The experiment was performed again, with a different sample of saturated AM (pH about 6.5). No color appeared in solution within 2.5 hrs at 75° C. at a pH of about 6.5. Concentrated ammonia (ca. 10 mL) was added to bring the pH to about 8.5. Within 2 hours at 75° C., the solution was deep blue.

HAVAR™ was evaluated for compatibility with a saturated ammonium heptamolybdate (AM) solution by placing a thin piece of HAVAR™ in a beaker and covering with saturated AM (pH about 6.5). The mixture was heated at 75° C. with stirring. No color was observed after three hours, and no Fe was detected by ICP-AES.

Based on these preliminary results, SS 316 or Ta demonstrated acceptable compatibility for construction of the target body 12. Nb appears to be suitable, as long as the pH of the solution remains near neutrality or weakly acid. However, Al 6061 demonstrated poor compatibility with the saturated AM solution. HAVAR™ demonstrated acceptable compatibility for use in the beam window 18. Similarly, PEEK also demonstrated favorable stability to permit its use for fittings and tubing in the target assembly 10.

Separation Methods for Technetium and Molybdenum.

A. SOLID PHASE EXTRACTION—RETAIN MOLYBDATE ON A COLUMN, ELUTE PERTECHNETATE: A stock solution of molybdate was prepared as follows: $MoO_3$ (natural abundance, 1.44 g) was combined with concentrated, aqueous $NH_3$ (3.0 mL) in deionized water (30 mL). 1.00 g of this solution was transferred to a 50.0-mL volumetric flask and diluted to the mark with deionized water. ICP-AES analysis of the resulting solution indicated 650 ppm in Mo.

A (i). A 5" glass, disposable pipet with a small tissue plug was charged with neutral alumina (1.0 g). Deionized water was added until breakthrough. This required 0.75 mL water, indicative of the column volume. 1.0 mL of the Mo stock solution (SS) was added to the top of the column. The first column volume of eluate (0.75 mL) was discarded, and then two 2.5-mL fractions were collected. Deionized water was added to continue the elution when the initial 1-mL charge was depleted. ICP-AES analysis of the eluted fractions showed that the first contained 68 ppm Mo, and the second 3.3 ppm.

A (ii). Another column was prepared as above, but this time only 0.5 mL of the Mo SS was charged. After discarding the initial 0.75 mL of eluate, two 2.5-mL fractions were taken, the first showing 3.8 ppm Mo, and the second 0.2 ppm.

A (iii). A column was run as per (ii), above, but 0.9% saline was used to pre-treat and to elute the column. The first 2.5-mL fraction contained 0.76 ppm Mo, and the second 2.0 ppm.

A (iv). A column was run as per (iii), above, but four 2.5-mL fractions were taken. In order of elution, these fractions contained 0.01, 3.1, 8.5, and 9.4 ppm Mo.

A (v). A column was run as per (iii), above, but basic alumina was used instead of neutral. In order of elution, the four fractions contained 69.2, 23.1, 4.9, and 1.2 ppm Mo.

A (vi). Two columns were prepared as per (iii), above. One was eluted with 0.9% saline, the other with approximately 5 N $NH_3$ (prepared from 5 mL concentrated $NH_3$ and 10 mL deionized water). Four fractions were taken from each column. In order of elution, the saline fractions contained 0.3, 5.9, 9.1, and 8.9 ppm Mo. The ammonia fractions contained 147, 1.9, 1.4, and 1.3 ppm Mo.

A (vii). A column was prepared from 1.0 g acidic alumina and pre-treated with 0.9% saline. It was charged with 0.5 mL Mo SS. After the first 0.75 mL was discarded, the column was eluted as per Table 1, below (2.5 mL fractions):

TABLE 1

| Fraction | 1 | 2 | 3 | 4 | 5 | 6 | 7 | 8 | 9 |
|---|---|---|---|---|---|---|---|---|---|
| Eluent | saline | saline | saline | saline | DI $H_2O$ | DI $H_2O$ | 5 N $NH_3$ | 5 N $NH_3$ | 5 N $NH_3$ |
| ppm Mo | 0.01 | 0 | 0 | 0 | 0.03 | 0.05 | 193 | 5.4 | 2.5 |

A (viii). A column was prepared as per (vii), above, but 65 μCi of sodium pertechnetate was added to the 0.5 mL Mo SS before elution. The initial 0.75 mL was discarded (no radioactivity). The elution profile (2.5 mL fractions) is given in Table 2, below (the ICP-AES data were collected the next day to allow the Tc to decay):

TABLE 2

| Fraction | 1 | 2 | 3 | 4 | 5 | 6 | 7 | 8 | 9 |
|---|---|---|---|---|---|---|---|---|---|
| Eluent | saline | saline | saline | saline | DI $H_2O$ | DI $H_2O$ | 5 N $NH_3$ | 5 N $NH_3$ | 5 N $NH_3$ |
| ppm Mo | 0 | 0 | 0 | 0 | 0 | 0 | 157 | 4.2 | 2.1 |
| Dose μCi | 63 | 0 | 0 | 0 | 0 | 0 | 0 | 0 | 0 |

A (ix). A column was prepared as per (viii), above, with 64 μCi of Tc added. The initial 0.75 mL was discarded (no radioactivity). The elution profile (2.5 mL fractions) is given in Table 3, below (the ICP-AES data were collected the following day to allow the Tc to decay):

TABLE 3

| Fraction | 1 | 2 | 3 |
|---|---|---|---|
| Eluent | saline | DI $H_2O$ | 5N $NH_3$ |
| ppm Mo | 0 | 0 | 158 |
| Dose μCi | 59 | 0 | 0 |

A (x). One more 1-g acidic alumina column was pre-treated with saline and charged with 0.5 mL molybdate SS to which 7.9 μCi of a molybdate-99/pertechnetate-99m solution (0.1 mL) was added. The first 0.75 mL (no radiation) was discarded, and the column was eluted as shown in Table 4, below:

TABLE 4

| Fraction | 1 | 2 | 3 | 4 | 5 | 6 | 7 |
|---|---|---|---|---|---|---|---|
| Eluent | saline | saline | DI $H_2O$ | DI $H_2O$ | 5 N $NH_3$ | 5 N $NH_3$ | 5 N $NH_3$ |
| μCi Tc-99 m | 5.2 | 0.2 | 0.04 | 0 | 0 | 0 | 0 |
| μCi Mo-99 | 0 | 0 | 0 | 0 | 2.9 | 0 | 0 |

0.2 μCi of activity remained on the column.

The basic principle in the operation of a Mo-99/Tc-99m generator is that molybdate is held by acidic alumina, whereas pertechnetate can be removed by elution with dilute saline. In the case of the Mo-99/Tc-99m generator, the molybdate is of the form $^{99}MoO_4^{-2}$; and as it decays to $^{99m}TcO_4^{-1}$, the pertechnetate is removed (once or twice a day) until the $^{99}Mo$ is depleted. In the case of the present process, the irradiated Mo-100 solution will contain $^{100}MoO_4^{-2}$, $^{99}MoO_4^{-2}$, and $^{99m}TcO_4^{-1}$. So, the objective was to isolate all the pertechnetate at once and remove the molybdate for recycling to the irradiation cell.

Neutral and basic alumina were tested first for the ability to retain molybdate. Neutral alumina demonstrated a modest retention of molybdate, holding about 0.3 mg Mo/g alumina. Basic alumina was less effective, holding almost none of the molybdate. Ammonia solutions were able to remove molybdate from neutral alumina.

Acidic alumina demonstrated high retention of molybdate, but still permitted the release of molybdate upon elution with ammonia. As it is desirable to return the molybdate to the accelerator free from sodium, small column experiments were run where ammonium molybdate, spiked with (sodium) pertechnetate, was added to a saline-treated, acidic alumina column, eluted with saline to remove the pertechnetate, eluted with water to remove residual sodium salt, and then eluted with 5 N ammonia to remove the molybdate. Efficient separation was obtained using as little as two column volumes of eluent per step.

B. SOLID PHASE EXTRACTION—RETAIN PERTECHNETATE ON A COLUMN, ELUTE MOLYBDATE: 3 N solutions of $NH_4Cl$, NaCl, and $NH_3$ were prepared by mixing the appropriate volumes of concentrated HCl, concentrated ammonia, 10 N NaOH, and deionized water. SuperLig® 639 resin (IBC Advanced Technologies, American Fork, Utah) was equilibrated in deionized water for two hours or more before use. A Tc/Mo stock solution (SS) was prepared by adding 1.85 mCi $NaTcO_4$ solution to 10 mL of saturated AM.

B (i). A disposable pipet was used to prepare a solid phase extraction column and the pipet was charged with 1.7 g wet SuperLig® resin. The column was then preconditioned by passing 5 mL of saturated AM (see Section A above) through it. 60 μL of Tc/Mo SS was added to the column, and the column was eluted according to the profile in Table 5:

TABLE 5

| Fraction | 1 | 2 | 3 | 4 | 5 | 6 |
|---|---|---|---|---|---|---|
| Eluent | 3 N $NH_4Cl$ | 3 N $NH_4Cl$ | 3 N NaCl | DI $H_2O$ | DI $H_2O$ | DI $H_2O$ |
| Volume (mL) | 5 | 5 | 5 | 5 | 5 | 10 |
| μCi Tc | 0 | 0 | 0 | 7.0 | 2.0 | 1.5 |
| ppm Mo | * | * | * | 2750 | 176 | 52 |

*not determined-expected to be high

A white precipitate was observed in Fraction 1.

B (ii). The same column from B (i) was re-used. First, the column was pre-treated with 5 mL saturated AM, and then 1540 μL of Tc/Mo SS (2 hours after initial preparation—203 μCi) was added. The column was eluted as shown in Table 6 (5.8 μCi of activity remained on the column).

TABLE 6

| Fraction | 1 | 2 | 3 | 4 | 5 | 6 | 7 |
|---|---|---|---|---|---|---|---|
| Eluent | 3 N $NH_4Cl$ | 3 N $NH_4Cl$ | 3 N NaCl | DI $H_2O$ | DI $H_2O$ | DI $H_2O$ | DI $H_2O$ |
| Volume (mL) | 5 | 5 | 5 | 5 | 5 | 5 | 10 |

TABLE 6-continued

| Fraction | 1 | 2 | 3 | 4 | 5 | 6 | 7 |
|---|---|---|---|---|---|---|---|
| μCi Tc | 0.6 | 0.5 | 1.0 | 41 | 111 | 32 | 14 |
| ppm Mo | * | * | * | 890 | 76 | 59 | 15 |

*not determined-expected to be high

A white precipitate was observed in Fraction 1.

B (iii). A fresh column was prepared with 1.8 g wet SuperLig® resin and pre-treated with 5 mL saturated AM. 2 mL of Tc/Mo SS (4 hours after preparation—256 μCi) was added; and the column was eluted as shown in Table 7 (1 μCi remained on the column):

TABLE 7

| Fraction | 1 | 2 | 3 | 4 | 5 | 6 |
|---|---|---|---|---|---|---|
| Eluent | 3 N $NH_4OH$ | 3 N NaCl | 75° C. DI $H_2O$ | 75° C. DI $H_2O$ | 75° C. DI $H_2O$ | 75° C. DI $H_2O$ |
| Volume (mL) | 5 | 5 | 5 | 5 | 5 | 10 |
| μCi Tc | 5.8 | 1.7 | 155 | 72 | 21 | 2 |
| ppm Mo | * | * | 15 | 295 | 26 | 4 |

*not determined-expected to be high

B (iv). An AM solution containing 15% (w/w) Mo was prepared as follows: a 250-mL beaker was charged with $MoO_3$ (22.5 g) and deionized water (60 g). The slurry was stirred, and concentrated ammonia solution (9.5 mL) was added at once. The stirred mixture was heated to 70° C. to facilitate dissolution. The resulting solution had a pH of 6.0. Additional concentrated ammonia (0.5 mL) was added, bringing the pH to 6.5. Deionized water was added to bring the total mass to 100 g. This AM solution was used in experiments B (v)-B (viii).

B (v). A small (0.7 cm ID×10 cm H) column was charged with 0.81 g damp SuperLig® 639 resin. The column was equilibrated by passing 3.0 mL AM solution (15% Mo) through it slowly. The flow rate was controlled by a stopcock. The flow rate was generally between 0.1 to 0.5 mL/min. A sample solution was prepared by adding 5.35 mCi of a pertechnetate-99m solution (~0.2 mL) to 3.0 mL AM solution. This was passed through the resin, followed by 3.0 mL 3N $NH_3$, then 3 mL 3N NaCl, then three times 3 mL hot (~70° C. when added, but cooled during the elution), and deionized water. The elution profile is given in Table 8. Radiometric data for all fractions and the column were taken 205 min after the initial dose (the 5.35 mCi) was measured. The column retained 0.19 mCi Tc.

TABLE 8

| Fraction | 1 | 2 | 3 | 4 | 5 | 6 |
|---|---|---|---|---|---|---|
| Eluent | Sample | 3 N $NH_4OH$ | 3 N NaCl | 70° C. DI $H_2O$ | 70° C. DI $H_2O$ | 70° C. DI $H_2O$ |

TABLE 8-continued

| Fraction | 1 | 2 | 3 | 4 | 5 | 6 |
|---|---|---|---|---|---|---|
| Volume (mL) | 3 | 3 | 3 | 3 | 3 | 3 |
| mCi Tc | 0.08 | 0.09 | 0.02 | 1.01 | 2.14 | 0.14 |
| ppm Mo | 5213 | 29,525 | 27.8 | 46.9 | 15.9 | 1.74 |

B (vi). Another column of the same size was charged with 1.42 g damp SuperLig® 639. The procedure in Experiment B (v) was followed, with the exception that 4.69 mCi Tc was added to the AM solution. The elution rate was slower, so the radiometric data were obtained 365 min after the initial charge. The elution data are recorded in Table 9. The column retained 0.17 mCi Tc.

TABLE 9

| Fraction | 1 | 2 | 3 | 4 | 5 | 6 |
|---|---|---|---|---|---|---|
| Eluent | Sample | 3 N $NH_4OH$ | 3 N NaCl | 70° C. DI $H_2O$ | 70° C. DI $H_2O$ | 70° C. DI $H_2O$ |
| Volume (mL) | 3 | 3 | 3 | 3 | 3 | 3 |
| mCi Tc | 0 | 0 | 0 | 0.04 | 1.35 | 0.85 |
| ppm Mo | 130,650 | 58,000 | 834 | 25.9 | 10.6 | 280 |

B (vii). A 0.7 cm ID×10 cm H column was packed with 1.31 g damp SuperLig® 639 resin and connected to a pump and a 4-port valve. The pump flow rate was set at 0.2 mL/min. The resin was equilibrated by first pumping 3 mL AM solution (15% Mo) through. The sample solution contained 4.37 mCi Tc in 3 mL AM solution. Radiometric data were obtained 215 minutes after the initial charge. The elution data are recorded in Table 10. The column retained 0.92 mCi Tc, and a purge of the lines delivered another 0.31 mCi.

TABLE 10

| Fraction | 1 | 2 | 3 | 4 | 5 | 6 | 7 |
|---|---|---|---|---|---|---|---|
| Eluent | Sample | 3 N $NH_4OH$ | 3 N NaCl | 70° C. DI $H_2O$ | 70° C. DI $H_2O$ | 70° C. DI $H_2O$ | 70° C. DI $H_2O$ |
| Volume (mL) | 3 | 3 | 3 | 3 | 3 | 3 | 3 |
| mCi Tc | 0 | 0 | 0.01 | 0 | 0.15 | 0.64 | 0.47 |
| ppm Mo | 125,000 | 94,900 | 1442 | 155 | 138 | 13.8 | 2.57 |

B (viii). A 0.5 cm ID×10 cm H column was packed with 1.51 g damp SuperLig® 639 resin and connected to a pump and a 4-port valve. To ensure full wetting of the resin with AM solution, 4 mL of the solution was pumped in at 5 mL/min, after which a flow rate of 0.5 mL/min was maintained throughout the run. This provided a small liquid head above the resin. For each subsequent fluid, 3 mL of liquid and 0.4 mL air were pumped, to allow for complete transfer through the lines. The sample solution contained 488 μCi of Tc. (Because the technetium sample was 24 hours old, this required about 0.4 mL.) Radiometric data were obtained 102 minutes after the initial charge. Elution data are recorded in Table 11. The column retained 47 μCi of Tc, and line purges delivered another 25 μCi.

TABLE 11

| Fraction | 1 | 2 | 3 | 4 | 5 | 6 |
|---|---|---|---|---|---|---|
| Eluent | Sample | 3 N $NH_4OH$ | 3 N NaCl | 70° C. DI $H_2O$ | 70° C. DI $H_2O$ | 70° C. DI $H_2O$ |
| Volume (mL) | 3 | 3 | 3 | 3 | 3 | 3 |
| μCi Tc | 0 | 0 | 0 | 2 | 199 | 143 |
| ppm Mo | 126,100 | 61,000 | 1422 | 65.6 | 11.2 | 4.55 |

SuperLig® 639 is a resin used to remove pertechnetate from wastewater. Pertechnetate can be removed from the SuperLig® 639 resin with water or dilute salt solutions, preferably at elevated temperature. If ammonium pertechnetate is adsorbed on the resin, pertechnetate can be removed as the sodium salt by exchanging the ammonium ions for sodium ions before elution.

Initial testing had a saturated AM solution, spiked with pertechnetate charged to a SuperLig® resin column (pretreated with saturated AM), eluted first with 3 N $NH_4Cl$ to remove the molybdate as the ammonium salt, then with 3 N NaCl to exchange the ammonium ions for sodium ions, then eluted with water to remove the pertechnetate in a less concentrated saline. The separation of technetium and molybdenum was satisfactory, but carry-over of molybdenum into the technetium fractions was observed. Additionally, ammonium chloride eluate contained a significant quantity of a white precipitate (presumably ammonium molybdate that salted out by the presence of the excess ammonium ions).

C. SEPARATE MOLYBDATE AND PERTECHNETATE BY LIQUID-LIQUID EXTRACTION: AM solutions were prepared by stirring together 1.44 g $MoO_3$, 3 mL 26° Be $NH_3$ (ca. 27-31 wt %), and 3 mL deionized water until dissolved. Dilute aqua regia was prepared by mixing 2 parts concentrated HCl, 2 parts concentrated $HNO_3$, and 96 parts deionized water.

C (i). A 125-mL plastic bottle was charged with AM solution and 75 mL methyl ethyl ketone (MEK). The mixture was stirred vigorously, then left to stand. The MEK phase was decanted into a 125-mL separatory funnel. No obvious aqueous phase was observed, but 1 mL was drained, and the remainder transferred to a 100-mL beaker. The MEK was evaporated under a stream of nitrogen, and the beaker was rinsed with 2 mL dilute aqua regia. The rinse was analyzed by ICP-AES and showed ca. 100 ppm Mo.

C (ii). A 125-mL plastic bottle was charged with AM solution and 70 mL MEK. The mixture was stirred vigorously, then left to stand. The MEK phase was decanted into a 125-mL separatory funnel. As the MEK phase was hazy, it was transferred to another 125-mL bottle and stirred with 3.6 g anhydrous sodium sulfate. The mixture was filtered, and the filtrate evaporated under nitrogen. The residue was dissolved in 5.95 g dilute aqua regia, giving 4.37 ppm Mo by ICP-AES analysis.

C (iii). A 154 μCi aliquot of sodium pertechnetate solution was added to AM solution. The Tc/Mo solution was then stirred with 75 mL MEK in a 125-mL plastic bottle. The whole mixture was transferred to a 125-mL separatory funnel, and the phases were allowed to separate. The aqueous phase, with some white precipitate visible, was removed, showing 2 μCi of activity. The MEK phase contained 156 μCi of activity. Evaporation under a nitrogen stream took three hours, leaving 111 μCi. Three hours later, the activity was 76 μCi. Addition of 3 ml 0.9% saline extracted 47 μCi; another 2-mL extraction removed 6 more μCi. 22 μCi remained in the plastic bottle. A 6-mL dilute aqua regia rinse of the bottle contained 20 ppm Mo (~0.12 mg).

C (iv). Experiment C (iii) was repeated, except that only 97 μCi of Tc and 25 mL MEK were used. After phase separation, the aqueous phase and precipitate contained 3 μCi of activity, the MEK phase contained 98 μCi. A 6-mL dilute aqua regia extraction of the bottle after evaporation of the MEK contained ~500 ppm (3 mg) Mo.

C (v). 91 μCi Tc was added to AM solution and shaken with 5 mL MEK in a 15-mL centrifuge tube. The phase separation was slow, so the mixture was centrifuged at 1200 rpm for five minutes. The MEK phase was removed by pipet and contained 85 μCi; the aqueous phase contained 5 μCi. The MEK was evaporated, and the residue extracted with 6 mL dilute aqua regia. The acid contained ~225 ppm (~1.4 mg) Mo.

Experiments with pertechnetate-spiked saturated AM solutions showed that technetium was essentially quantitatively extracted into MEK when using a volume of MEK that is greater than that of the aqueous solution. A minor amount of molybdenum was found in the MEK, but could be eliminated by the use of a drying agent (e.g., sodium sulfate) to treat the MEK after extraction. Evaporation of the MEK with a nitrogen stream and dissolution of the residue in 0.9% saline gave a technetium solution product with negligible ammonium salt. If desired, trace molybdenum and organics in the technetium solution product can be removed with a short plug of alumina and/or charcoal.

Experiments A (viii)-(x), B (i)-(iii), and C (iii) generate pertechnetate primarily as the sodium salt, although traces of ammonium ion could remain, which advantageously matches the form provided by the reactor-based generators that are eluted with saline.

CYCLOTRON EXPERIMENTS Irradiations were performed at the University of Washington Medical Center in Seattle, Wash. using the MC50 cyclotron. The proton beams used for these experiments were 16.5 MeV protons with currents between 1-10 μA. A standard PET target and control system was purchased from, installed and operated by Bruce Technologies, Inc., Chapel Hill, N.C. Tantalum was selected for the target liner and HAVAR™ for the beam window. Natural molybdenum was used as the target material.

An automated chemistry system was assembled and operated by IsoTherapeutics Group, LLC., Angleton, Tex. Components for this system were supplied by Valco Instruments Co., Inc., Houston, Tex. The configuration was substantially similar to that used Experiments B(vii)-B(viii) with the addition of an alumina column, as described below. A germanium (Ge) detector and dose calibrator (Capintec, Inc., Ramsey, N.J.) were used to examine the radioactive products. Measurements were performed on each fraction/sample collected after the separation (2 hrs after irradiation), the next day and several days later. The initial signal (511 keV gammas) for N-13, C-11 and other positron emitters (various Tc isotopes, Mo-91, F-18) were detected and mapped over time to observe their decay. The (approx.) 140 keV signal of Tc-99m was clearly seen. Other characteristic signature emissions were observed (specifically several other technetium isotopes).

Ammonium heptamolybdate, sodium molybdate and potassium molybdate solutions were prepared using natural molybdenum. Between (approximately) 50 and 75% saturated solutions were used. Solutions were prepared as follows for the cyclotron runs (all 15% w/w Mo): Ammonium molybdate: 22.5 g $MoO_3$, 60 mL DI $H_2O$, 10 mL con. $NH_4OH$, then DI $H_2O$ to 100 g. (pH 6.5); Sodium molybdate: 22.5 g $MoO_3$, 30 mL DI $H_2O$, 30 mL 10 N NaOH, then DI $H_2O$ to 100 g (pH 8); and Potassium molybdate: 22.5 g $MoO_3$, 30 mL DI $H_2O$, 30 mL 10 N KOH, then DI $H_2O$ to 100 g. (pH 8.5)

The target and lines required about 2.5-3.0 mL of target solution to fill. The chemistry schedule was similar to that tested previously: 0.594 g damp Superlig resin; 0.259 g acidic alumina resin; 3 mL 15% molybdate+1 mL air to Recycle vial (used to pre-treat the column); 3 mL Target material+1 mL air to Recycle vial (Mo-100 recovery); 3 mL 3N $NH_4OH$ (or NaOH or KOH)+1 mL air to Dilute Mo vial (Mo-100 recovery); 3 mL 3N NaCl+1 mL air to Waste vial; 3 mL water+1 mL air to Waste vial; 8 mL water and 2 mL air to Product vial through alumina column.

Five experiments were performed—3 with ammonium, one with sodium and one with potassium molybdate solutions:

Experiment 1

Ammonium molybdate; irradiated with 2 μA for one minute. The irradiated fluid target material matrix solution turned dark blue indicating that a species change had occurred. A similar observation was made during the material compatibility testing for certain pH ranges. However, by the next day the solution had reverted back to colorless. Without being bound by any particular theory, the color change from dark blue to colorless was attributed to oxidation of the colored species by air. The target was inspected and found to be intact and not affected by the irradiation experiment conditions.

Experiment 2

Repeat of experiment 1 for 2.5 μA and two minutes.

Experiment 3

Potassium molybdate; irradiated 5 μA for 10 mins. The irradiated target matrix solution was clear at the end of the irradiation.

Experiment 4

Ammonium Molybdate; irradiated 5 μA (average) for 10 mins; peak current was 10 μA. Blue coloration was again observed during irradiation/heating. Oxygen was bubbled through the irradiated fluid target matrix solution for 5 mins and the blue color started to dissipate.

Experiment 5

Sodium Molybdate; irradiated 5 μA (average) for 10 mins; peak current was 10 μA. Target solution was clear at the end of the irradiation.

EXAMPLE

Approximate Tc99m distribution at each time point following the irradiation and automated chemistry on sodium molybdate:

| Time (after irradiation) | Mo Recycle + Dilute Mo | Waste + Superlig Column | Product + Al Column |
|---|---|---|---|
| 2 hrs | 0% | 9% | 91% |
| 18 hrs | 3% | 7% | 90% |
| 5 days | 100% | NA | 0% |

The chemical separations of the irradiated samples were performed using the automated solid phase extraction system described above. The product pathway contained almost all the directly produced Tc-99m and molybdenum fractions were isolated substantially-free of any directly produced Tc-99m. However, Mo-99 was also produced which decayed into Tc-99m over several days. Only a minute trace of Na-22 was observed in the recycled molybdenum material, while no Na-22 was observed in the Tc-99m product.

As used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprising", "including", "characterized by" and "having" can be used interchangeably.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative product and/or method and examples shown and described. The various features of exemplary embodiments described herein may be used in any combination. Accordingly, departures may be made from such details without departing from the scope of the general inventive concept.

What is claimed is:

1. A method of producing Tc-99m, the method comprising:
irradiating a fluid target matrix comprising Mo-100 with a proton beam to directly transform at least a portion of Mo-100 to Tc-99m via a Mo-100(p,2n)Tc-99m reaction and provide an irradiated fluid target matrix; and
isolating Tc-99m from the irradiated fluid target matrix.

2. The method of claim 1, wherein the fluid target matrix further comprises water.

3. The method of claim 2, wherein the Mo-100 is derived from a water soluble molybdenum compound selected from the group consisting of molybdenum oxide, ammonium molybdate, and alkali metal molybdates.

4. The method of claim 2, wherein the water is $H_2{}^{18}O$, and at least a portion of the O-18 is transformed to F-18.

5. The method of claim 4, further comprising:
separating at least a portion of the F-18 from the irradiated fluid target matrix.

6. The method of claim 2 wherein the fluid target matrix has a pH of about 2 to about 12.

7. The method of claim 1 further comprising:
isolating the Mo-100 from the irradiated fluid target matrix to provide a recovered sample of the Mo-100; and
irradiating the recovered sample of the Mo-100 with a proton beam to transform at least a portion of the recovered sample of the Mo-100 to the Tc-99m.

8. The method of claim 1, wherein the fluid target matrix comprises an organic liquid.

9. The method of claim 1, wherein the fluid target matrix comprises a gas or a mixture of gases, and the Mo-100 is derived from a gaseous molybdenum compound.

10. The method of claim 1 wherein protons of the proton beam have an average energy of at least about 7 MeV.

11. The method of claim 1, wherein isolating Tc-99m from the fluid target matrix comprises:
transferring the irradiated liquid target matrix out of an irradiation target body; and
separating at least a portion of Tc-99m from Mo-100.

12. The method of claim 11, wherein separating at least a portion of Tc-99m from Mo-100 comprises:
loading a sample of the irradiated liquid target matrix onto a solid phase extraction system;
eluting the Tc-99m and the Mo-100 from the solid phase extraction system with at least one eluent solution to separate at least a portion of the Tc-99m from at least a portion of the Mo-100; and
collecting at least a portion of the at least one eluent solution discharged from the solid phase extraction system to provide an eluted technetium fraction enriched in the Tc-99m and an eluted molybdenum fraction enriched in the Mo-100.

13. The method of claim 12, wherein the eluted technetium fraction is eluted from the solid phase extraction system before the eluted molybdenum fraction.

14. The method of claim 12, wherein the eluted molybdenum fraction is eluted from the solid phase extraction system before the eluted technetium fraction.

15. The method of claim 11, wherein separating at least a portion of the Tc-99m from the Mo-100 comprises:

partitioning the irradiated liquid target matrix between an organic solvent phase and an aqueous phase to produce a product enriched in the Tc-99m.

16. The method of claim 15, wherein the organic solvent phase comprises methyl ethyl ketone.

17. The method of claim 1, wherein another portion of the Mo-100 in the fluid target matrix is transformed to Mo-99 in the irradiated fluid target matrix, and the method further comprising isolating Mo-100 and Mo-99 from the irradiated fluid target matrix to provide a recovered sample of molybdenum that is substantially free of a direct irradiation produced Tc-99m; and separating at least a portion of Tc-99m derived from a natural decay of Mo-99 from the recovered sample of molybdenum.

18. The method of claim 1, further comprising producing a plurality of radionuclides:

by concurrently producing at least one of F-18, N-13, O-15, or C-11, wherein the fluid target matrix further comprises at least one of O-18, O-16, or N-14, wherein irradiating the fluid target matrix with the proton beam transforms at least a portion of Mo-100 to Tc-99m, and transforms at least a portion of the O-18 to F-18, at least a portion of the O-16 to N-13, at least a portion of the O-16 to O-15, or at least a portion of the N-14 to C-11, and thereby provide an the irradiated fluid target matrix; and separating from the irradiated fluid target matrix at least a portion of the Tc-99m and at least a portion of the F-18, the N-13, O-15, and/or the C-11.

19. The method of claim 18, wherein the Mo-100 is derived from a water soluble molybdenum compound selected from the group consisting of molybdenum oxide, ammonium molybdate, and alkali metal molybdates.

20. The method of claim 18, wherein the O-18 is derived from $H_2{}^{18}O$, ${}^{18}O_2$, or ${}^{100}Mo^{18}O_3$, the O-16 is derived from $H_2{}^{16}O$, ${}^{16}O_2$, or ${}^{100}Mo^{16}O_3$, or the N-14 is derived from ${}^{14}NH_3$, ${}^{14}NH_4{}^{+1}$, ${}^{14}N_2$, ${}^{14}N^{16}O_3{}^{-1}$, ${}^{14}N^{18}O_3{}^{-1}$, or $({}^{14}NH_4)_6Mo_7O_{24}$.

21. The method of claim 1, further comprising:

transferring an aqueous solution of a water soluble molybdenum compound comprising Mo-100 into a target assembly, wherein the aqueous solution has a pH in a range from about 2 to about 12; wherein the target assembly comprises a target body and a beam window; wherein the target body comprises stainless steel, tantalum, a cobalt alloy, or a polyether ether ketone; and wherein the beam window comprises cobalt, titanium, tantalum, tungsten, stainless steel, gold, or alloys thereof.

22. The method of claim 21, wherein the beam window has a thickness in a range from approximately 0.3 μm to 50 μm.

23. The method of claim 21, wherein irradiating the fluid target matrix comprising Mo-100 with the proton beam is performed with proton energies in a range from about 7 MeV to about 30 MeV at a beam power within a range from approximately 1.5 kW to 15.0 kW.

* * * * *